US007774964B2

(12) United States Patent
L'Hôtel

(10) Patent No.: US 7,774,964 B2
(45) Date of Patent: Aug. 17, 2010

(54) INFORMATION DISPLAY SUPPORT

(76) Inventor: Francois L'Hôtel, Le Moulin à Vent, Larchant (FR) 77760

( * ) Notice: Subject to any disclaimer, the term of this patent is extended or adjusted under 35 U.S.C. 154(b) by 507 days.

(21) Appl. No.: 11/576,855

(22) PCT Filed: Oct. 5, 2005

(86) PCT No.: PCT/FR2005/002453

§ 371 (c)(1),
(2), (4) Date: Jan. 28, 2008

(87) PCT Pub. No.: WO2006/037896

PCT Pub. Date: Apr. 13, 2006

(65) Prior Publication Data

US 2008/0244948 A1 Oct. 9, 2008

(30) Foreign Application Priority Data

Oct. 6, 2004 (FR) ..... 04 10519
Sep. 12, 2005 (FR) ..... 05 09255

(51) Int. Cl.
*G09F 1/06* (2006.01)

(52) U.S. Cl. ..... 40/539; 248/174; 40/124.07; 40/60.12

(58) Field of Classification Search ..... 40/606.12, 40/610, 737, 124.07; 248/174
See application file for complete search history.

(56) References Cited

U.S. PATENT DOCUMENTS 6,347,772 B1 2/2002 L'Hotel
7,134,230 B1 * 11/2006 Boens et al. ..... 40/610
7,159,350 B2 * 1/2007 L'Hotel ..... 40/610
7,634,865 B2 * 12/2009 L'Hotel ..... 40/610
2002/0171023 A1 11/2002 L'Hotel
2007/0245610 A1 * 10/2007 Mestres Armengol et al. . 40/610

FOREIGN PATENT DOCUMENTS

FR 2 847 062 A 5/2004
FR 2925203 A1 * 6/2009
GB 350 798 A 6/1931
GB 2430534 A * 3/2007

* cited by examiner

*Primary Examiner*—Cassandra Davis
(74) *Attorney, Agent, or Firm*—Novak Druce+Quigg; J. Rodman Steele, Jr.; Gregory M. Lefkowitz

(57) ABSTRACT

The support comprises at least one sheet (2) of a substantially rigid and foldable material having a display face (3), elastic return and constraint bands (44) for making the display face of the sheet convex, and a plurality of inserts (18-20) for keeping the display face of the sheet in the convex state, opposing the elastic constraint bands, and exerting their force in a discretely distributed way along the display face of the sheet. The inserts (18-20) have a length equal to the distance between the two lateral edges (8, 9) of the sheet (2), in its convex state, the sheet being extended by two sets of lateral tabs (12, 13, 14, 15, 16, 17) intended to form two sets of dihedrals for receiving the inserts, the elastic bands (44) interacting with the inserts and the tabs (12-17) and exerting, in addition to their horizontal constraint force, vertical forces in opposite directions (49, 50) to keep the inserts at the correct height in the convex state of the display face.

17 Claims, 4 Drawing Sheets

INFORMATION DISPLAY SUPPORT

The invention relates to the field of display units for supporting information for communication or visual advertising at points of sale, known as PSA. The display units according to the invention are columns which can be folded back on themselves and unfolded virtually automatically, having the advantage of being able to be transported and stored in excellent condition, on the one hand, and of being very rapidly installed on site, on the other hand.

More precisely, the invention relates to an information display unit support having at least one display face, comprising at least one sheet of a substantially rigid foldable material having the said display face, elastic return and constraint means for making the display face of the sheet convex and a plurality of inserts for keeping the display face of the sheet in the convex state, opposing the elastic constraint means, and having an action discretely distributed along the said display face of the sheet.

Starting from a folded-back state, it is simply necessary to start to unfold the support to cause it to unfold fully automatically under the action of the constraint means. Naturally, in the opposite direction, the folding back of the support is carried out against the action of the constraint means.

Such a display support is disclosed in the document FR 2,824,946.

In this support, the retaining bands or inserts have a length which is less than the distance between the two lateral edges of the sheet, or of the panel, offering the display face in its convex state.

To keep the elastic bands fixed, on the one hand, to a terminal fixing and stop portion of the inserts, and, on the other hand, to stop edges, or tabs, laterally extending the sheet of the display face, it is also proposed, in this prior art document, that flaps be provided for the passage and retention of the elastic bands.

In addition to the disadvantage of the difficulty of sliding the elastic bands into the flaps, these flaps stiffen the terminal portions of the inserts, which, relatively speaking, makes the rest of the inserts fragile with a risk of causing them to buckle.

In any case, and therefore because of the reduced length of the inserts, the problem of keeping them at the correct height or in a horizontal position when the unit is in the deployed state is still as great, this problem being directly related to the existence of this plurality of discrete elementary inserts.

It was therefore this problem that the applicant attempted to resolve. At this point the applicant thought of returning to previous solutions and initially taking up again one of the ideas leading to the development of an even earlier unit support as described in the document FR 2,760,880, and in which a single opposing rear supporting panel which is continuous along the front panel of the display face bears with its lateral edges in the dihedrals formed by the front panel of the display face and its lateral tabs.

Thus the invention relates to a display unit of the type specified above, characterized in that the supporting inserts opposing the elastic constraint means have a length equal to the distance between the two lateral edges of the sheet, in its convex state, this sheet being extended beyond the display face by two sets of lateral tabs intended to form two sets of dihedrals for receiving the supporting inserts and the elastic means are arranged to interact with the supporting inserts and the tabs and to exert, in addition to their horizontal constraining force, vertical forces in opposite directions to keep the supporting inserts at the correct height in the convex state of the display face.

Therefore, in order to propose his new invention, on the basis of the teachings of FR 2,824,946, the applicant initially returned to an earlier concept and then developed a specific design of the interaction between the supporting inserts, the tabs of the display face sheet, and the constraining elastic bands. This provides evidence of an inventive step.

Preferably, the elastic means associated with each supporting insert comprise at least one elastic connector closed on to itself interacting with one of the tabs of the sheet and a terminal fixing and stop portion of the insert so that it takes the form of a trapezoid with two base portions parallel to the lateral edges of the sheet and two portions inclined in opposing directions on these edges so as to exert two vertical forces in opposite directions on the associated insert by the resolution of the forces applied to these inclined portions.

Advantageously, the elastic connection is received in two substantially rectilinear inclined cut-outs in the terminal portion of the insert, acting to provide the relative positioning of the tab and the terminal portion of the insert, and acting as a hook for the elastic connection.

Advantageously again, the terminal fixing and stop portion of the insert has an edge parallel to the lateral edges of the sheet and, formed from this edge, a circular cut-out preventing any jamming between the tab and the said terminal portion of the insert.

Thus, if, owing to the elastic, the tab is slightly curved, the edge of the curvilinear cut-out acts as a guide to prevent any jamming between the two supporting parts of the unit joined by the elastic connection.

In a preferred embodiment of the supporting inserts, each of their rectilinear cut-outs links two edges of the inserts orthogonal to the lateral edges of the sheet and not extending into each other's extensions.

The display unit support according to the invention can have at least two sheets, each having a display face, the supporting inserts comprising two terminal fixing and stop portions.

Each of the supporting inserts, regardless of whether the display unit has one or more display faces, can have, opposite its terminal fixing and stop portion, a terminal portion for hinging to a tab of the single sheet or to a plurality of tabs of a plurality of sheets, interlinked by an elastic return and constraint connection.

In another embodiment of the display unit according to the invention, each supporting insert is rectangular and is associated with a single elastic connection closed on to itself and folded into a cross having two lateral segments extending substantially along the lateral edges of the sheet and two diagonal segments in the form of a cross connecting the ends of the lateral segments, the elastic connection being fixed to the lateral tabs in such a way that the edges of the supporting insert orthogonal to the lateral edges of the sheet practically bear on the diagonal segments of the elastic connector and so that the supporting insert is thus kept at the correct height.

Preferably, the lateral tabs of the sheet are divided into elementary portions spaced apart from each other and associated with corresponding support inserts, having a greater height than that of the inserts, the elastic connectors being fixed in cut-outs formed along the dihedrals between the sheet and the elementary portions of the tabs.

In a specific embodiment, it is possible to provide at least two sheets, each having a display face, each extended by two tabs pressed in pairs against single sides of the inserts by the elastic connectors.

As seen above, the applicant was concerned in avoiding any jamming between the tabs of the sheet and the supporting inserts.

For the same purpose, the applicant proposes, in yet another different embodiment, with the supporting inserts extending in the form of a first layer and lateral tabs of the sheet extending in the form of a second layer, that the elastic constraint means extend in the form of a third layer interleaved between the two layers of the inserts and the tabs.

Preferably, the elastic means associated with each supporting insert comprise at least one elastic connection closed on to itself interacting with one of the tabs of the plane and a terminal fixing and stop portion of the insert so that it takes the form of a triangle with one base portion parallel to the lateral edges of the plane and two portions inclined in opposing directions on these edges so as to exert two vertical forces in opposite directions on the associated insert by the resolution of the forces applied to these inclined portions.

In this case, it is advantageous for the elastic connection to be attached to a hook formed in the terminal fixing and stop portion of the insert and received in two cut-outs of the associated tab, the hook of the insert and the cut-outs of the tab being positioned so that, under the force exerted by the elastic connection to make the sheet convex, when the terminal portion of the insert and the associated tab come into line with each other in an area at the start of covering, each said inclined portion of the elastic connection passes through one such said area.

Preferably, the terminal fixing and stop portion of each insert has a lateral edge parallel to the lateral edges of the sheet with a jamming prevention cut-out forming two stop areas.

Preferably also, each insert hook is formed by cutting a cut-out shaped for this purpose.

The invention will be more clearly understood with the aid of the following description of four useful embodiments of the display unit support, with reference to the attached drawing, in which.

Figure 1:
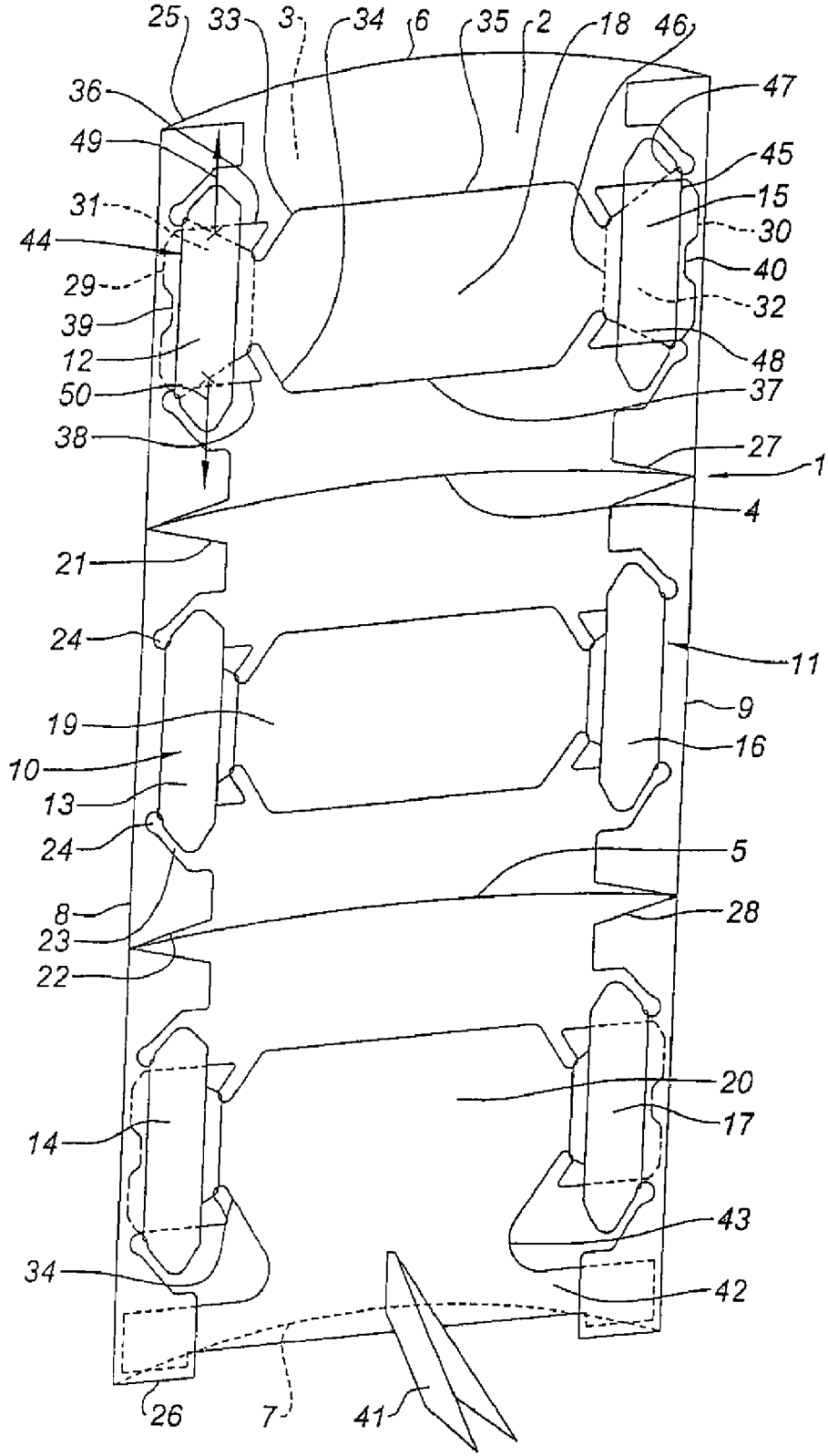
FIG. 1 is a perspective view from the rear of a first embodiment of the display unit support according to the invention, having a single sheet, in the deployed state.

With reference to FIG. 1, the display unit support 1 has a sheet 2 with a display face 3, made from a substantially rigid material, cardboard in this case, and foldable back on to itself along two intermediate lines 4, 5, parallel to the upper 6 and lower 7 edges of the sheet.

The sheet 2 has two lateral edges 8, 9, perpendicular to the upper and lower edges 6, 7 in the undeployed state of the support, or to the planes in which these edges extend when the support is in the deployed state, as in FIG. 1 and when the sheet is convex, and, beyond these lateral edges 8, 9, the sheet 2 is extended by two lateral tabs 10, 11, each cut out to release elementary tab portions, numbering three in this case, 12, 13, 14 and 15, 16, 17, separated from each other on either side of the folding lines 4, 5 and associated with supporting inserts 18, 19, 20 respectively.

Each elementary tab portion 12-17 forms a dihedral for receiving a supporting insert 18-20.

Near their transverse edges 21, 22, and considering only a single elementary tab portion 12, since the same applies to the others, there is formed a curvilinear cut-out 23 inclined towards the corresponding edge 22 and terminating in an eyelet 24 for receiving an elastic connection mentioned below, two eyelets of a single elementary tab portion being spaced apart by a distance greater than the width of the supporting inserts 18, 19, except in the case of the lower terminal insert 20.

The upper edges 25 of the elementary tab portions 12, 15 are perpendicular to the lateral edges 8, 9 of the sheet 2, as are the lower edges 26 of the lower elementary tab portions 14, 17. Conversely, the lower edges 27 of the upper elementary tab portions 12, 15, the two transverse edges 21, 22 of the single intermediate tab portions 13, 16 in this case and the upper transverse edges 28 of the lower tab portions 14, 17 are cut to form bevels to permit the folding and undeploying of the support.

The supporting inserts 18-20, also made from cardboard in this case, are of generally rectangular shape. Their length is equal to the distance separating the two lateral edges 8, 9 of the sheet 2, in its convex state shown in FIG. 1, their lateral edges 29, 30, parallel to the lateral edges of the sheet 2, being positioned in the dihedral formed by the sheet 2 and its elementary tab portions 12-17, bearing against the insides of the transverse edges 8, 9 of the sheet 2.

Each of the supporting inserts 18-20 has two terminal fixing and stop portions 31, 32, extending from their lateral edges 29, 30 to two rectilinear cut-outs 33, 34 inclined towards these edges, to receive in this way the elastic connections described below. The width of these terminal fixing and stop portions 31, 32 is less than the width of the central part of the inserts.

In other words, each cut-out 33, 34 connects two edges of the inserts 35, 36 and 37, 38, orthogonal to the lateral edges 8, 9 of the sheet 2, in other words to the lateral edges 29, 30 of the inserts, not extending into each other's extensions.

The two inserts 18, 19 are identical and there is formed in each of their terminal portions, from the lateral edge 29, 30, a circular cut-out 39, 40 whose function is to prevent any jamming between the elementary tab portion and the corresponding terminal portion of the insert. If the elastic band 44 makes the elementary tab portion 12 slightly convex, so that it develops a certain depth, if the lateral edge of the insert did not have this circular cut-out, in the case of a narrow tab portion, the risk of jamming would be really evident.

The final, lower insert 20, intended to be placed near the ground and therefore having a support foot 41, is wider than the others, and has a lower transverse band 42 extending under the lower curvilinear cut-outs 34 of the final elementary tab portions 14, 17, and linked to the inner edges of the rectilinear cut-outs by wide necks 43.

Each elementary tab portion 12-17 is connected to a terminal fixing and stop portion 31, 32 of an insert by an elastic connection 44 closed on to itself, in other words an elastic band, received, on the one hand, after having been slid into the curvilinear cut-outs 23, in the eyelets 24 of the tab portion, and, on the other hand, in the rectilinear cut-outs 33, 34 of the terminal portion of the insert acting as hooks. Each elastic band 44 thus takes the form of a trapezoid with two base portions 45, 46 parallel to the lateral edges 8, 9 of the sheet 2, of which one outer portion 45 is outside the tab portion, visible in FIG. 1, and the other inner portion 46, shorter than the other, against the inside of the insert, is invisible and shown in broken lines in FIG. 1, and two portions 47, 48 inclined in opposing directions on these lateral edges and slid between the tab portion and the insert. By resolution of the elastic forces applied to these inclined portions of elastic band 47, 48, the elastic band interacts with the insert and the tab portion of the sheet to exert, from the tab portion, not only an orthogonal (horizontal) force on the insert directed towards the outside to pull the terminal portion into the dihedral, with its lateral edge 29, 30 against the inner corner 8, 9 of the dihedral between the sheet and the tab portion, but also two vertical forces in opposite directions 49, 50, so that, by means of the hooks 33, 34 of the supporting insert in question, it is kept at the correct height, in other words in a horizontal position when the support is in its deployed state, the display face 3 in the convex state, thus constrained by the elastic band 44. The relative positioning of the tab portion and of the terminal portion of the insert is thus provided.

It will be noted that the supporting inserts 18-20 therefore exert forces opposing the elastic bands 44 which are to be called return and constraint forces, these forces being exerted in a discretely distributed way along the sheet 2 and its display face 3.

Figure 2:
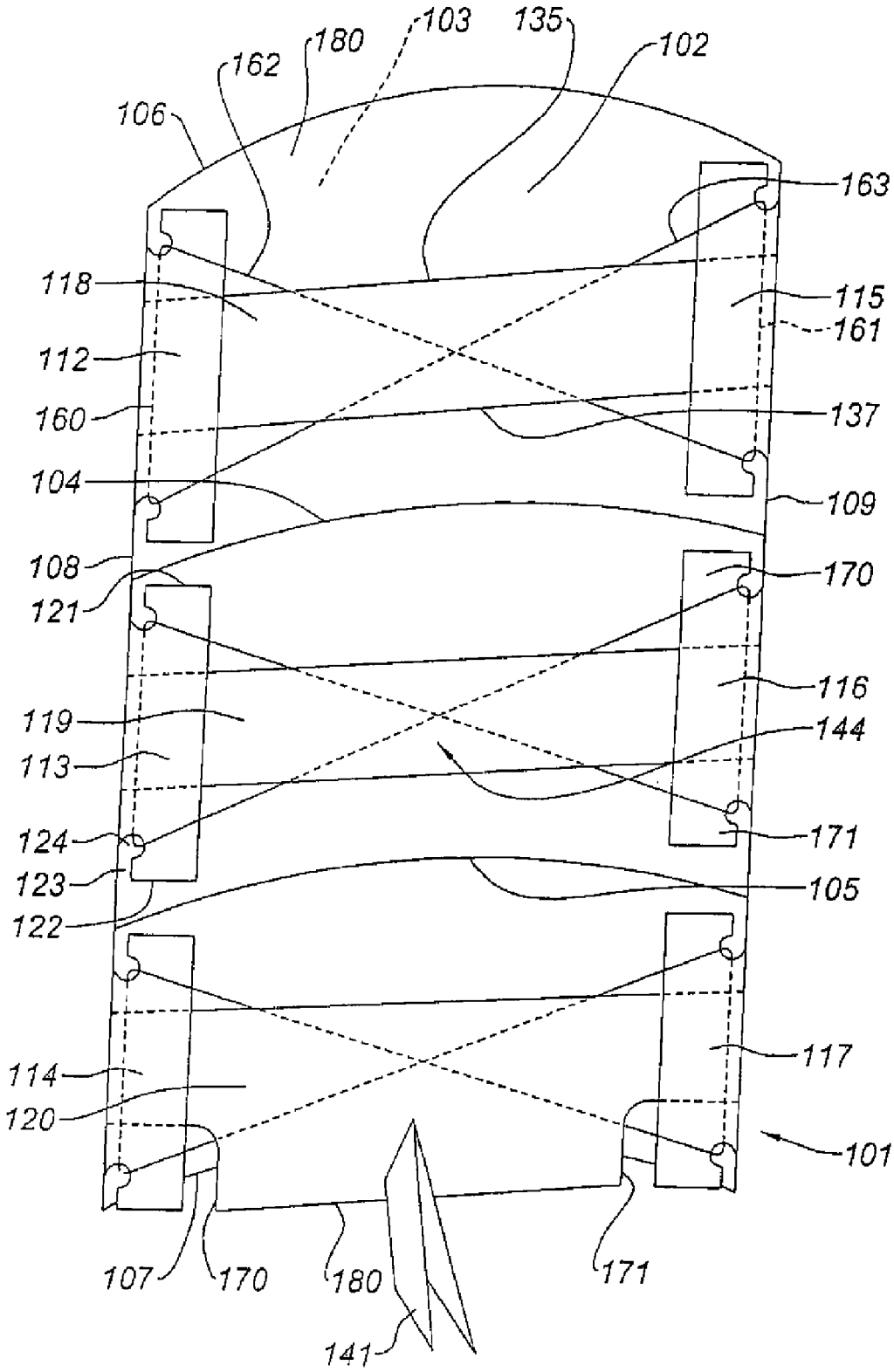
FIG. 2 is a perspective view from the rear of a second embodiment of the display unit support according to the invention, having a single sheet, in the deployed state.

The embodiment of the display unit support 101 of FIG. 2 is similar to the preceding one, but simpler. The corresponding elements are therefore referenced as in FIG. 1 but with the addition of one hundred.

Again, it has a sheet 102, with a display face 103, and elementary tab portions 112-117, of rectangular shape in this case, beyond the lateral edges 108, 109, spaced apart from each other, and supporting inserts 118-120 which are also totally rectangular except for the final one 120, for a reason which is made clear below. The length of the inserts is again equal to the distance separating the two lateral edges of the sheet in the deployed state. Their width is markedly smaller than the length (the height) of the elementary tab portions in this case.

The elementary tab portions are cut out at their two ends 170, 171, near their transverse edges, to create along the corner of the dihedral which each of them forms with the sheet a rectilinear cut-out 123 terminating in an eyelet 124 for receiving an elastic connector.

Each supporting insert is kept in place by a single elastic connector 144 closed on to itself and folded back to form a cross. Each insert being inserted between the rear face 180 of the sheet 102, seen in FIG. 2, and two elementary tab portions, with its lateral edges bearing in the dihedrals, each elastic band 144, received in the corresponding four eyelets 124, extends in the form of two lateral segments 160, 161 extending substantially along the lateral edges of the sheet 102, between the sheet and the tab portions, and two diagonal segments 162, 163 forming a cross connecting the ends of the lateral segments, the diagonal segments passing behind the ends 170, 171 of the elementary tab portions, then seen in FIG. 2, and in front of the inserts, between the rear face 180 of the sheet and these inserts, as shown in broken lines in FIG. 2. Thus, each elastic band 144, fixed to the two elementary tab portions by the corresponding four eyelets, acts as a positioning stop for the associated insert whose edges 135, 137 orthogonal to the lateral edges 108, 109 of the sheet bear against the diagonal segments 162, 163 of the elastic band. Thus the supporting inserts are kept at the correct height, in a horizontal position.

It will be noted that the positioning is also provided by the resolution of the elastic forces exerted on the diagonal segments of the elastic bands, with vertical forces in opposing directions.

As regards the final lower insert 120, this has at its two lower lateral ends two large curvilinear cut-outs 170, 171 for the passage of the diagonal segments 162, 163 of the associated elastic band. This is because this insert has to rest on the ground with its lower edge 180, together with the lower edge 107 of the sheet 102, opposite the upper edge 106 and a support foot 141 is fixed to it.

Like the support of FIG. 1, the support 101 can be folded back on to itself about the folding lines 104, 105, against the action of the elastic bands 144.

Two embodiments of the display unit support have been described up to this point, each having a single display face and a single sheet. However, the display unit support according to the invention can have two or more of these.

Figure 3:
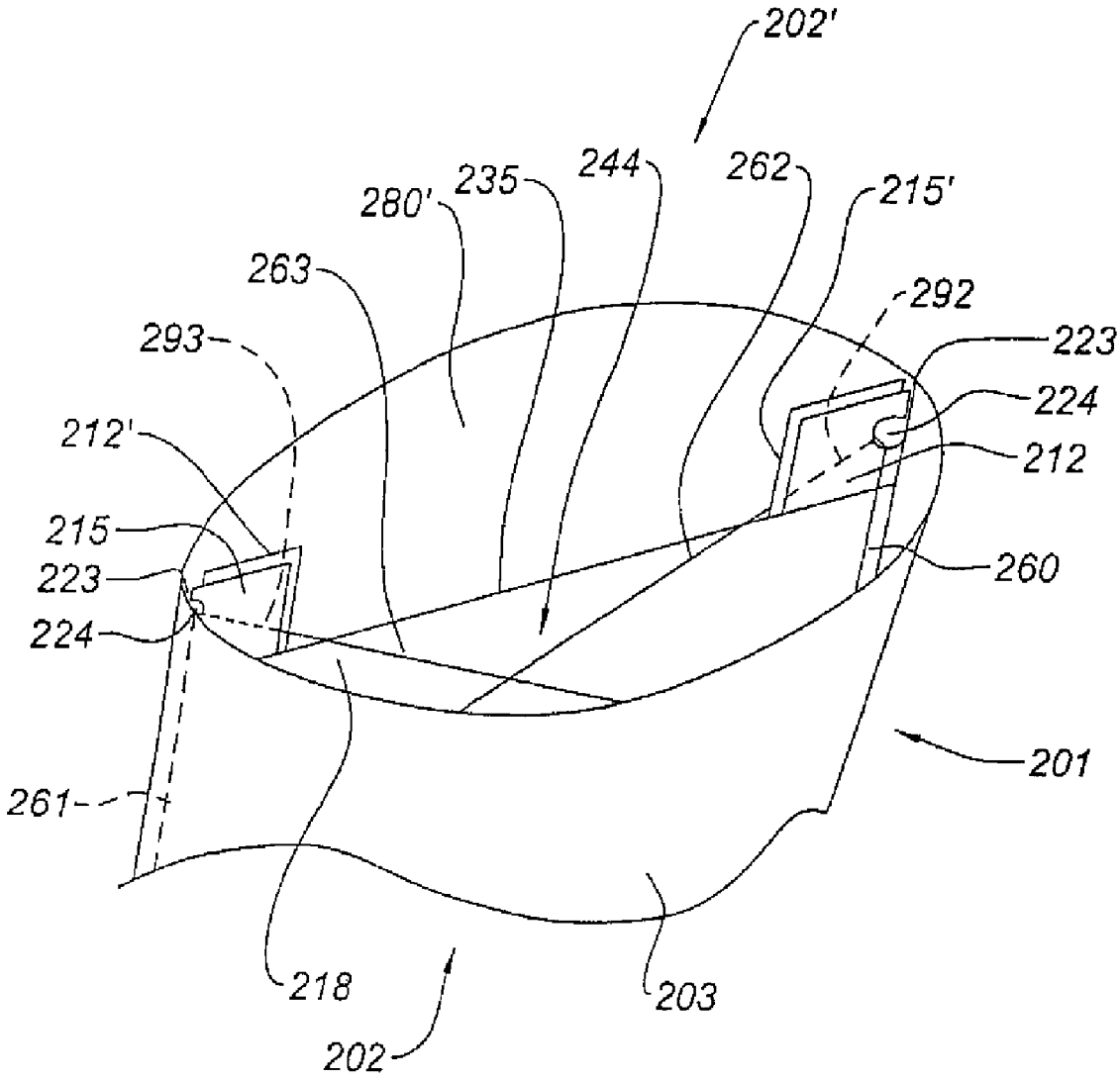
FIG. 3 is a perspective view from above of the upper part of a third embodiment of the display unit support according to the invention, having two sheets.

Thus, with reference to FIG. 3, the display unit support 201 has two sheets 202, 202', identical to the sheet of FIG. 2, joined back to back by their elementary tab portions 212, . . . 215 and 215', . . . 212' respectively. Clearly, as in the previous case, similar elements have the same references as in the other two figures, but increased by two hundred, with and without the addition of primes. Thus, FIG. 3 shows the sheets 202, 202', with, for one sheet 202', its rear face 208', and for the other sheet 202, its display face 203.

The same rectilinear cut-outs 223, each terminating in the same eyelet 224, are formed in the elementary tab portions, along the corners of the dihedrals.

On the other hand, the support 201 only has one set of supporting inserts 218 . . . . The elementary tab portions, joined together in pairs, are each pressed against a single side of the inserts 218 by the same elastic connections 244, with their lateral segments 260, 261 and their diagonal segments 262, 263. In this case, it will be observed that the inserts are received only in a single set of dihedrals formed between a sheet and its intermediate tab portions, in this case the sheet 202. But, since the tab portions of the two sheets are joined together in pairs, the arrangement is equivalent: in functional terms, it is as if the inserts were equally received in the dihedrals formed between the other sheet 202' and its elementary tab portions 212' . . . 215'.

The elastic connections 244 are passed into the pairs of eyelets 224 of the two sheets. In the case shown in FIG. 3, the lateral elements 260, 261 of the elastic bands 244 extend more or less along the faces of the inserts 218 turned towards the rear face of the sheet 202, in the same way as the central portions of the diagonal elements 262, 263, whose terminal portions 292, 293, extending up to the eyelets 224, extend along the faces of the elementary tab portions 212' . . . 215' of the other sheet 202', turned towards the rear face 280' of the latter. Thus, owing to the crossing of the inserts and of the tab portions, the diagonal elements of the elastic bands pass from one side to the other of the assemblies formed by the inserts and tab portions at the level of the angles formed by the inserts and the tab portions, thus providing a bearing element for the transverse edges 236 . . . of the inserts, and keeping them at the correct height, in a horizontal position.

Figure 4:
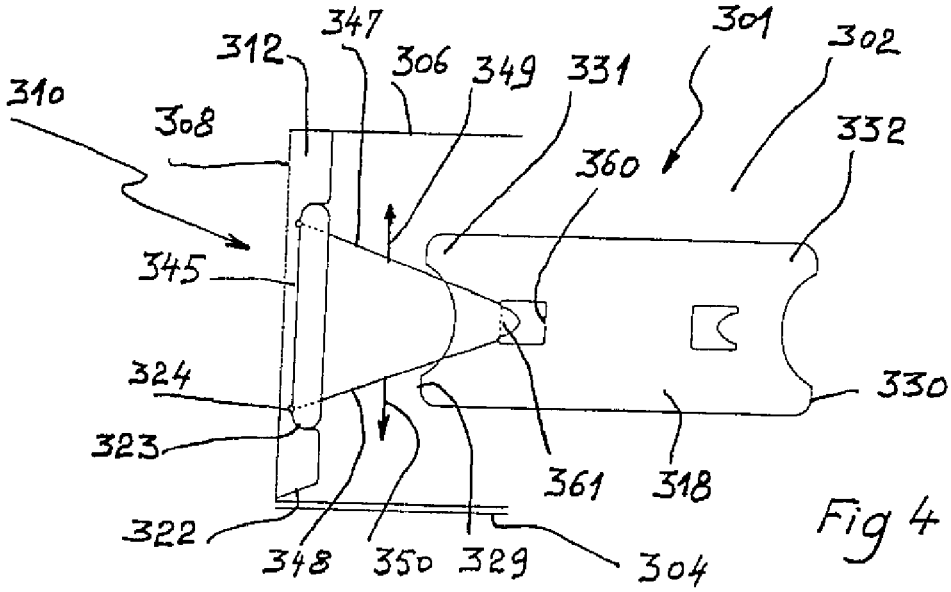
FIG. 4 is a rear view of part of the fourth embodiment of the support, having a single sheet, in the flattened, not convex, state of the sheet.
Figure 5:
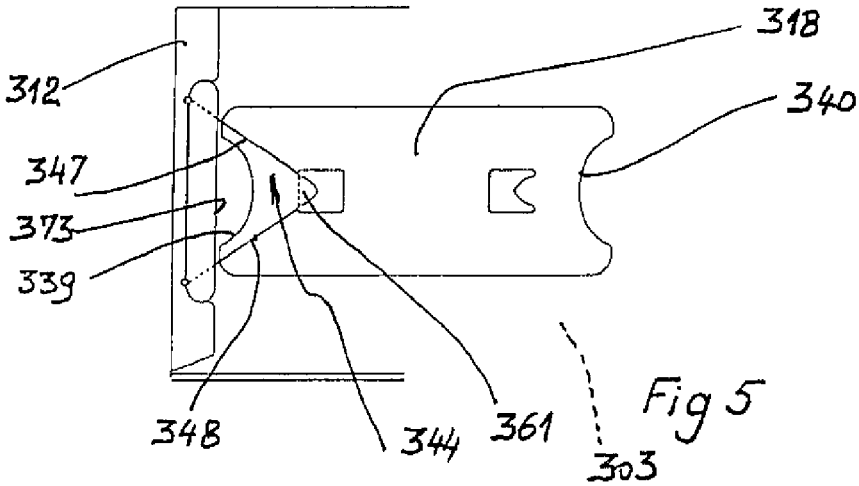
FIG. 5 is a view similar to that of FIG. 4 but in the course of the deployment of the support.
Figure 6:
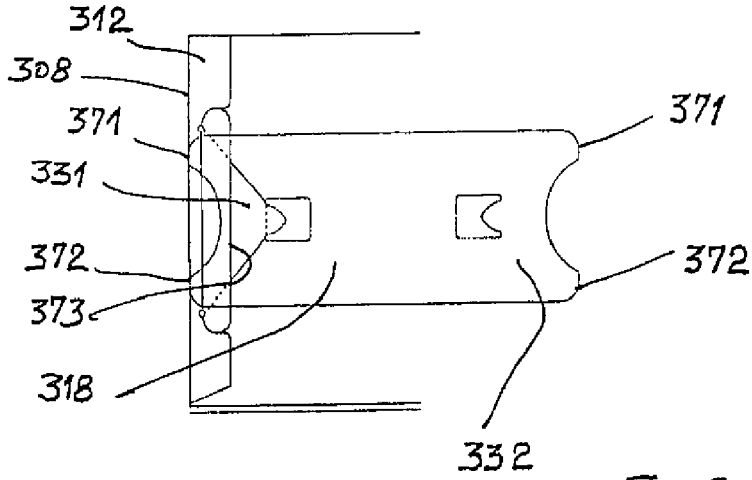
FIG. 6 is a view similar to that of FIG. 4, in the convex state of the sheet.

The embodiment of the display unit support 301 of FIGS. 4-6 is similar to that of FIG. 1. The corresponding elements are therefore referenced as in FIG. 1 but with the addition of two hundred. The display unit support 301 has a single sheet 302 extending between an upper edge 306 and a lower edge and two lateral edges perpendicular to the first two, including the edge 308. Beyond the two lateral edges, the sheet 302 is extended by two lateral tabs, including the tab 310, each cut out to free elementary tab portions, including the tab 312, separated from each other on either side of folding lines, including the line 304, and associated with corresponding supporting inserts, including the insert 318.

Each elementary tab portion 312 forms a dihedral for receiving a supporting insert 318.

Near their transverse edges 322, there is formed a curvilinear cut-out 323 inclined towards the corresponding edge 322 and terminating in an eyelet 324 for receiving an elastic connection described below, two eyelets of a single elementary tab portion being spaced apart by a distance greater than the width of the supporting inserts 318.

As in the embodiment of FIG. 1, the two transverse edges of the intermediate tab portions are cut to form bevels to permit the folding and undeploying of the support, in the same way as the lower edges of the upper tab portions and the upper edges of the lower tab portions.

The supporting inserts 318, also made from cardboard in this case, are of generally rectangular shape. Their length is equal to the distance separating the two lateral edges 308 of the sheet 302, in its convex state shown in FIG. 6, their lateral edges 329, 330, parallel to the lateral edges of the sheet, being positioned in the dihedrals formed by the sheet and its elementary tab portions 312, bearing against the insides of the transverse edges 308 of the sheet.

Each of the supporting inserts 318 has two terminal fixing and stop portions 331, 332 extending from its lateral edges 329, 330 to a median cut-out 360, having an appropriate general shape, rectangular in this case, forming a small hook-like point 361 of the associated transverse edge 308, so that the elastic connections described below can thus be received.

The inserts 318 are identical and there is formed in each of their terminal portions, from the lateral edge 329, 330, a circular cut-out 339, 340 whose function is to prevent any jamming between the elementary tab portion and the corresponding terminal portion of the insert. However, it will be understood from the following text that this jamming is actually prevented by another important characteristic of this support.

Each elementary tab portion 312 is linked to a terminal fixing and stop portion 331, 332 of an insert by an elastic connection 344 closed on to itself, in other words an elastic band, received, on the one hand, after having been slid into the curvilinear cut-outs 323, in the eyelets 324 of the tab portion, and, on the other hand, in the cut-out 360 of the terminal portion of the insert, on the hook 361. Each elastic band 344 thus takes the form of a triangle with a base portion 345, parallel to the lateral edges 308 of the sheet 302, and two portions 347, 348 inclined in opposing directions on these lateral edges and slid between the tab portion and the insert. By resolution of the elastic forces applied to these inclined portions of elastic band 347, 348, the elastic band interacts with the insert and the flap portion of the sheet to exert, from the flap portion, not only an orthogonal (horizontal) force on the insert directed towards the outside to pull the terminal portion into the dihedral, its lateral edge 329, 330 against the inner corner 308, of the dihedral between the sheet and the flap portion, but also two vertical forces in opposite directions 349, 350, so that, by means of the hooks 361, of the supporting insert in question, it is kept at the correct height, in other words in a horizontal position when the support is in its deployed state, with the display face 303 in the convex state, being thus constrained by the elastic band 344. The relative positioning of the tab portion and of the terminal portion of the insert is thus ensured.

The supporting inserts 318 exert forces opposing those of the elastic bands 344 which are to be called return and constraint forces, these forces being exerted in a discretely distributed way along the sheet 302 and its display face 303.

Jamming between the tabs and the inserts, when the display unit support is deployed, is completely prevented because of the following characteristics, and initially by the first of these.

The supporting inserts 318 extend virtually in the form of a first flat layer. The lateral tabs 312, for their part, extend in the form of a second flat layer. The elastic bands 344 are attached to the hooks 361 of the inserts and in the cut-outs 323 of the lateral tabs so that their inclined portions 347, 348 extend in front of the lateral tabs, in other words between these tabs and the rear face of the sheet 302, and behind the inserts 318, in other words they extend in the form of a third layer interposed between the layer of the tabs 312 and the layer of the inserts 318.

On the other hand, because of the cut-out 339, 340, the lateral edge 329 of a terminal fixing and stop portion 331 of the inserts 318 is approximately reduced to two terminal stop segments 371, 372. The spacing of the eyelets 324 of the cut-outs 323 of the lateral tabs 312 and the positioning of the hooks 361 of the inserts 318 are such that, under the force exerted by the elastic bands 344 to make the sheet 302 convex, when these edge segments 371, 372 of the tabs 312 become aligned with the inner lateral edges 373 of the tabs 312, as in FIG. 5, the inclined portions 347, 348 of the elastic bands 344 pass across these edge segments, between the tabs and the inserts, thus finally ensuring that there will be no jamming.

Clearly, the embodiment of FIGS. 4-6 could be changed by doubling the display faces and the sheets with their tab portions. The characteristics described above would be fully maintained, since the elastic bands would be attached no longer to a single tab portion, but to two portions of the two sheets in question joined to each other, the inclined portions 347, 348 of the elastic bands continuing to extend between the single associated insert and the joined pairs of tab portions.

Clearly, again, any variant embodiment presented in respect of the other three preceding embodiments could also be envisaged on the basis of this fourth embodiment.

The invention claimed is:

1. Information display unit support having at least one display face comprising:

at least one sheet of a substantially rigid and foldable material having the said display face, elastic return and constraint means for making the display face of the sheet convex, and a plurality of supporting inserts for keeping the display face of the sheet in the convex state, opposing the elastic constraint means, and exerting their force in a discretely distributed way along the said display face of the sheet, wherein the supporting inserts opposing the elastic constraint means have a length equal to the distance between two lateral edges of the sheet in its convex state, the sheet being extended, beyond the display face, by two sets of lateral tabs intended to form two sets of dihedrals for receiving the supporting inserts, and wherein the elastic means are arranged to interact with the supporting inserts and the tabs and to exert, in addition to their horizontal constraint force, vertical forces in opposite directions to keep the supporting inserts at the correct height in the convex state of the display face.

2. Display unit support according to claim 1, in which the elastic means associated with each supporting insert comprise at least one elastic connection closed on to itself interacting with one of the tabs of the sheet and a terminal fixing and stop portion of the insert so that it takes the form of a trapezoid with two base portions parallel to the lateral edges of the sheet and two portions inclined in opposing directions on these edges so as to exert two vertical forces in opposite directions on the associated insert by the resolution of the forces applied to these inclined portions.

3. Display unit support according to claim 2, in which the elastic connection is received in two substantially rectilinear inclined cut-outs of the terminal portion of the insert, acting to provide the relative positioning of the tab and the terminal portion of the insert and acting as a hook for the elastic connection.

4. Display unit support according to claim 3, in which the terminal fixing and stop portion of the insert has an edge parallel to the lateral edges of the sheet and, formed from this edge, a circular cut-out preventing any jamming between the tab and the said terminal portion of the insert.

5. Display unit support according to claim 4, in which each of the rectilinear cut-outs of the inserts connects two edges of the inserts orthogonal to the lateral edges of the sheet not extending into each other's extensions.

6. Display unit support according to claim 1, in which there are provided at least two sheets, each having a display face, the supporting inserts having two terminal fixing and stop portions.

7. Display unit support according to claim 1, in which the supporting inserts have a terminal linking portion opposite terminal fixing and stop portions.

8. Display unit support according to claim 7, in which the terminal portion is a portion for linking to a tab of the sheet.

9. Display unit support according to claim 7, in which the terminal portion is a portion for linking to a plurality of tabs of a plurality of sheets, joined together by an elastic connection for return and constraint.

10. Display unit support according to claim 1, in which each supporting insert is rectangular and is associated with a single elastic connection closed on to itself and folded into a cross having two lateral segments extending substantially along the lateral edges of the sheet and two diagonal segments in the form of a cross connecting the ends of the lateral segments, the elastic connection being fixed to the lateral tabs in such a way that the edges of the supporting insert orthogonal to the lateral edges of the sheet practically bear on the diagonal segments of the elastic connector and the supporting insert is thus kept at the correct height.

11. Display unit support according to claim 10, in which the lateral tabs of the sheet are divided into elementary portions spaced apart from each other and associated with the corresponding support inserts, having a greater height than that of the inserts, the elastic connections being fixed in cut-outs formed along the dihedrals between the sheet and the elementary portions of the tabs.

12. Display unit support according to claim 10, in which at least two sheets are provided, each having a display face, each extended by two tabs pressed in pairs against the same side of the inserts by the elastic connections.

13. Display unit support according to claim 1, in which, with the supporting inserts extending in the form of a first layer and the lateral tabs of the sheet in the form of a second layer, the elastic constraint means extend in the form of a third layer interposed between the two layers of the inserts and the tabs.

14. Display unit support according to claim 13, in which the elastic means associated with each supporting insert comprise at least one elastic connection closed on to itself interacting with one of the tabs of the sheet and a terminal fixing and stop portion of the insert so that it takes the form of a triangle with a base portion parallel to the lateral edges of the sheet and two portions inclined in opposing directions on these edges so as to exert two vertical forces in opposite directions on the associated insert by the resolution of the forces applied to these inclined portions.

15. Display unit support according to claim 14, in which the elastic connection is attached to a hook formed in the terminal fixing and stop portion of the insert and received in two cut-outs of the associated tab, the hook of the insert and the cut-outs of the tab being positioned so that, under the force exerted by the elastic connection to make the sheet convex, when the terminal portion of the insert and the associated tab come into line with each other in an area at the start of covering, each said inclined portion of the elastic connection passes through one said area.

16. Display unit support according to claim 13, in which the terminal fixing and stop portion of each insert has a lateral edge parallel to the lateral edges of the sheet with a jamming prevention cut-out forming two stop areas.

17. Display unit support according to claim 13, in which each hook of the insert is formed by cutting a cut-out.

* * * * *